US009212445B2

(12) United States Patent
Erickson

(10) Patent No.: US 9,212,445 B2
(45) Date of Patent: Dec. 15, 2015

(54) METHOD AND APPARATUS FOR CONTROLLING THE LIQUID FILLING IN A LAUNDRY TREATING APPLIANCE

(75) Inventor: Donald E. Erickson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 950 days.

(21) Appl. No.: 13/327,916

(22) Filed: Dec. 16, 2011

(65) Prior Publication Data

US 2013/0152310 A1 Jun. 20, 2013

(51) Int. Cl.

| | |
|---|---|
| ***D06F 33/00*** | (2006.01) |
| ***D06F 33/02*** | (2006.01) |
| ***D06F 35/00*** | (2006.01) |
| ***D06F 39/08*** | (2006.01) |

(52) U.S. Cl.

CPC ..... *D06F 33/02* (2013.01); *D06F 35/006* (2013.01); *D06F 39/087* (2013.01); *D06F 39/088* (2013.01)

(58) Field of Classification Search

CPC ..... D06F 39/088; D06F 39/087; D06F 33/00; D06F 33/02; D06F 35/006; D06F 2058/2861

USPC ..... 8/158; 68/12.04, 12.05, 12.21, 12.27; 702/55

See application file for complete search history.

(56) References Cited

U.S. PATENT DOCUMENTS

| | | | | |
|---|---|---|---|---|
| 5,144,819 | A * | 9/1992 | Hiyama et al. | 68/12.04 |
| 7,380,303 | B2 * | 6/2008 | Bellinetto et al. | 8/158 |
| 7,536,881 | B2 * | 5/2009 | Lorenz et al. | 68/12.06 |
| 7,654,118 | B2 | 2/2010 | Lee et al. | |
| 8,215,134 | B2 * | 7/2012 | Ashrafzadeh et al. | 68/12.04 |
| 2004/0154644 | A1 * | 8/2004 | Kim | 134/18 |
| 2006/0143837 | A1 * | 7/2006 | McIllwain | 8/158 |
| 2008/0189875 | A1 * | 8/2008 | Czyzewski et al. | 8/159 |
| 2011/0010070 | A1 * | 1/2011 | Bohr et al. | 701/102 |

FOREIGN PATENT DOCUMENTS

| | | | |
|---|---|---|---|
| DE | 102010013386 | A1 | 10/2011 |
| JP | 2224796 | A | 9/1990 |
| JP | 2008054950 | A * | 3/2008 |
| KR | 20100082448 | A | 7/2010 |
| WO | 2008148844 | A2 | 12/2008 |

OTHER PUBLICATIONS

Machine translation of JP 2008054950 A, dated Mar. 2008.*

German Search Report for Counterpart DE102012109925, Jul. 16, 2013.

* cited by examiner

*Primary Examiner* — Joseph L Perrin
*Assistant Examiner* — Kevin G Lee

(57) ABSTRACT

Disclosed is a method of operating a horizontal axis laundry treating appliance to correct for an error in sensing an amount of supplied liquid caused by a determined change in the attitude of an associated wash tub.

24 Claims, 6 Drawing Sheets

METHOD AND APPARATUS FOR CONTROLLING THE LIQUID FILLING IN A LAUNDRY TREATING APPLIANCE

BACKGROUND OF THE INVENTION

A laundry treating appliance is a common household device for treating laundry in accordance with a preprogrammed treating cycle of operation. The laundry treating appliances typically have a configuration of a rotating drum positioned within a tub. The rotating drum is typically perforated and at least partially defines a treating chamber in which a laundry load is received for treatment according to the cycle of operation. The tub is typically imperforate and retains liquid used to treat the laundry load. A lower portion of the tub is typically used as a sump to collect the liquid.

The volume of liquid used in a laundry treating appliance may vary with fabric type, load size, and cycle of operation. Therefore, a liquid fill control is used to provide for the desired amount of the liquid. Known liquid fill controls include a pressure sensor to provide feedback for controlling the filling process. The pressure sensor may be coupled with a pressure tube fluidly coupled with the sump. As the machine fills, pressure inside the tube increases in direct proportion to the height of the liquid in the sump.

The pressure in the pressure tube is sensed by the pressure sensor, and is a function of the volume of free liquid in the sump, i.e. liquid not absorbed by and retained by the laundry load, and the angle of the tub and sump. When the washer fills with liquid, this angle may change depending on various factors such as how the laundry was loaded in the treating chamber and how the tub is suspended relative to the loading.

Loading of a front-loading laundry treating appliance, or "front loader," with laundry may result in an accumulation of laundry toward the forward end of the drum. These machines also typically fill from the forward end of the wash tub. Laundry in the forward portion of the drum may, therefore, be wetted first. This may increase the weight of the laundry load, particularly if the fabric comprising the load is relatively absorbent, and the forward portion of the tub may tilt downward in response. This tilting changes the angle of the tub and sump, and the angle of the free-liquid surface in the sump, which is sensed by the pressure sensor as a decrease in volume of the liquid, which results in an error in the reading of the pressure sensor.

The amount of error is, to some extent, a function of the relative locations of the load and pressure sensor as well as the type of suspension. The error may be on a single axis or multiple geometric axes of the tub. For example, in front loading laundry treating appliances, the pressure sensor is at the rear of the tub, opposite where the laundry is loaded, leading to a front-to-back error. The pressure sensor may also be laterally offset from the load, leading to a side-to-side error.

The erroneous reading will lead to either too much or too little liquid being supplied to the tub for the selected treating cycle of operation, which is undesirable in that it may lead to improper treating, increased energy costs, particularly if heated liquid is utilized and increased costs of water as a result of the excess.

BRIEF DESCRIPTION OF THE INVENTION

In one aspect, the invention is a method of operating a laundry treating appliance. The laundry treating appliance may include a tub defining an interior, and a drum defining a treating chamber for receiving laundry for treatment. The drum is located within the interior, rotatable about a rotational axis, and configured to automatically treat laundry according to at least one cycle of operation. The method includes determining an amount of liquid to be supplied to at least one of the interior and the treating chamber for the at least one cycle of operation. The method includes supplying liquid to at least one of the interior and the treating chamber. The method also includes sensing the amount of supplied liquid using a sensor operably coupled to the tub, and determining a change in the attitude of the tub during the supplying of the liquid. The method further includes correcting for an error in sensing the amount of supplied liquid caused by the determined change in the attitude of the tub.

In another aspect, the invention is a laundry treating appliance configured to automatically treat laundry according to at least one cycle of operation. The appliance may include a tub defining an interior, and a drum defining a treating chamber for receiving laundry for treatment. The drum is located within the interior and rotatable about a rotational axis. A liquid supply valve may selectively provide liquid to at least one of the interior and the treating chamber, and a liquid level sensor may provide a level output indicative of the level of the liquid in the tub. An attitude sensor may provide an attitude output indicative of a change in the attitude of the tub, and a controller may be operably coupled to the liquid supply valve, and may receive the level output and the attitude output. The controller may control the amount of liquid supplied for the at least one cycle of operation based on the level of liquid indicated by the level output, using the attitude output to correct for an error in the level output induced by a change in attitude.

DESCRIPTION OF AN EMBODIMENT OF THE INVENTION

Figure 1:
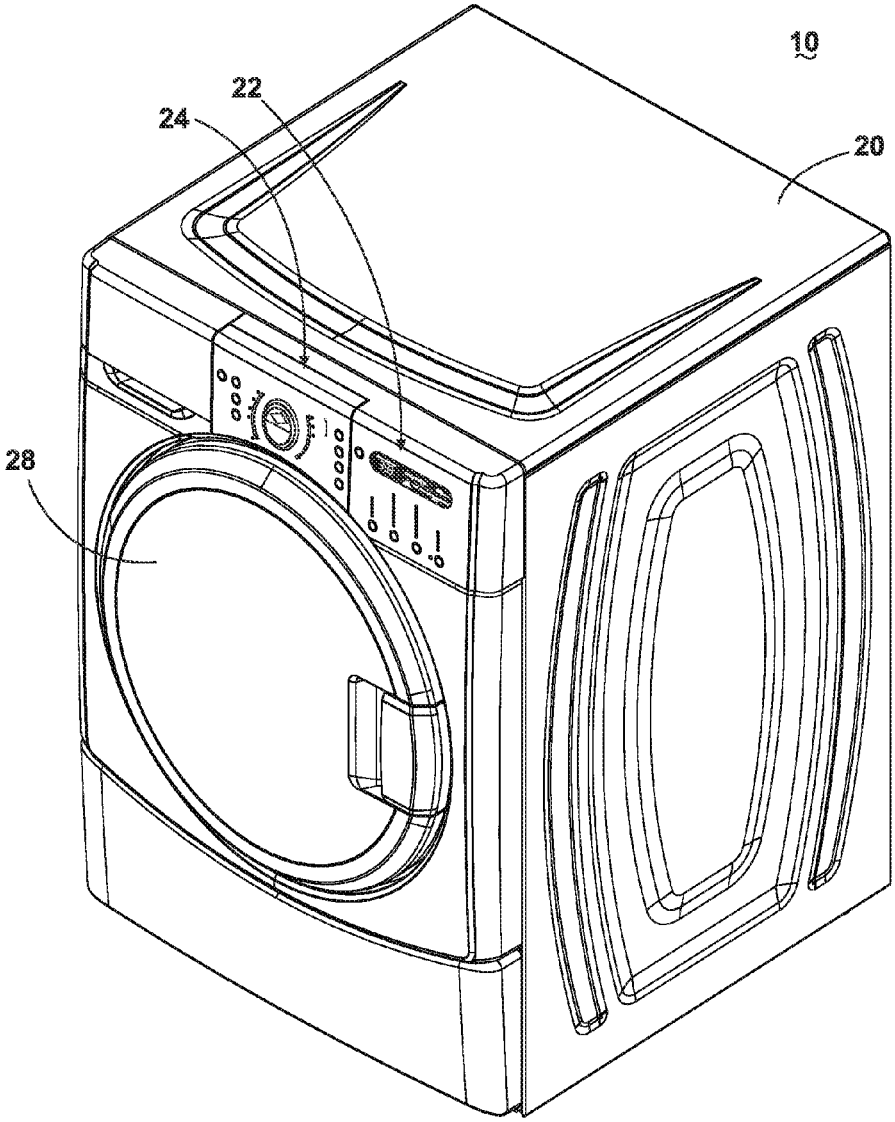
FIG. 1 is a perspective view of an exemplary laundry treating appliance in the form of a horizontal axis laundry treating appliance according to an embodiment of the invention.

Referring now to the drawings, FIG. 1 illustrates a laundry treating appliance 10 according to an embodiment of the invention. The laundry treating appliance 10 may be any suitable laundry treating appliance, such as a front-loading horizontal axis washing machine, a combination front-loading horizontal axis washing machine and dryer, a top-loading vertical axis washing machine, or a combination top-loading vertical axis washing machine and dryer.

The laundry treating appliance 10 may include a cabinet 20 closeable by an access door 28. A controller 22 mounted in the cabinet 20 may receive an input from a user outside the cabinet 20 and/or provide information to the user through a user interface 24 for selecting a cycle of operation, including operating parameters for the selected cycle. The controller 22 may also control the operation of the laundry treating appliance 10 to implement the selected cycle of operation.

As used herein, a "horizontal axis" laundry treating appliance refers to a laundry treating appliance having a drum that rotates about a horizontal axis relative to a generally horizontal surface supporting the laundry treating appliance. In some horizontal axis laundry treating appliances, the horizontal axis is generally parallel to the supporting surface. However, the rotational axis need not be perfectly horizontal or parallel to the surface. The drum may rotate about an axis that is inclined relative to the horizontal, with 15° of inclination being one example. As used herein, a "vertical axis" laundry treating appliance refers to a laundry treating appliance having a drum that rotates about a vertical axis relative to a generally horizontal surface supporting the laundry treating appliance. In some vertical axis laundry treating appliances, the vertical axis is generally perpendicular to the supporting surface. However, the rotational axis need not be perfectly vertical or perpendicular to the surface. The drum may rotate about an axis that is inclined relative to the vertical. The terms "horizontal" and "vertical" include orientations that are generally horizontal or vertical, as well as several degrees off a true horizontal or vertical orientation.

As used herein, "attitude of the tub" means "the orientation of at least one of the three principal axes of the tub relative to a reference frame, such as the three principal axes in a prior position." In a two dimensional setting, the orientation may be described in terms of the pitch angle and/or roll angle relative to the rotational axis of the drum or the body axis of the tub.

Figure 2:
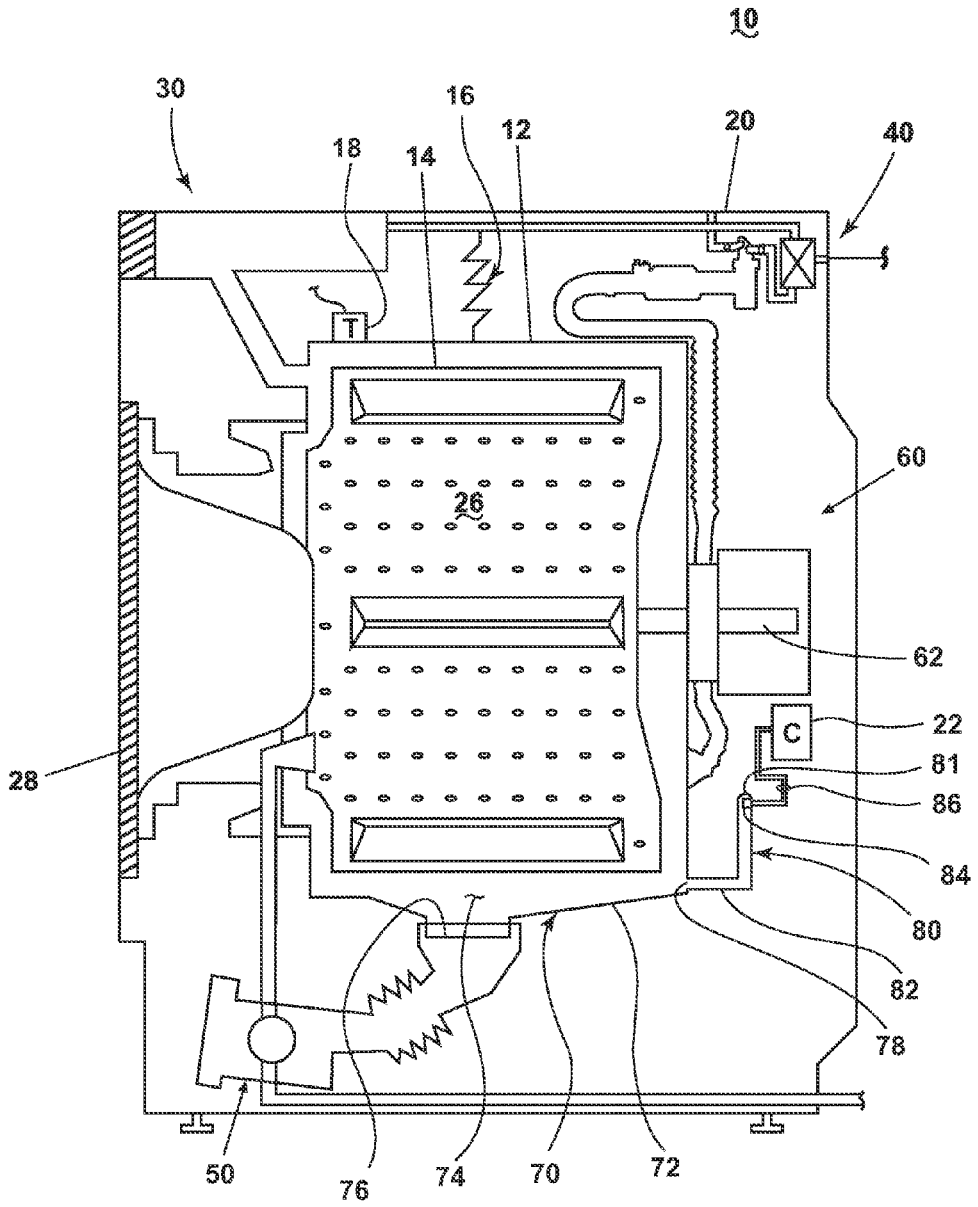
FIG. 2 is a partial schematic vertical sectional view taken through an axis of rotation of the laundry treating appliance of FIG. 1 illustrating a stationary tub with a sump, and a rotatable drum.

For illustrative purposes, the embodiment will be described with respect to a front-loading laundry treating appliance for cleaning a laundry load. As illustrated in FIG. 2, the laundry treating appliance 10 may include a stationary imperforate tub 12 defining an interior space, and a perforate rotatable drum 14 mounted in the interior space of the tub 12 and defining a wash chamber 26, both of which may be enclosed within the cabinet 20. The tub 12 may be supported within the cabinet 20 through a generally known combination of suspension elements 16, such as springs, dampers, cushions, bumpers, and the like, at selected locations. Changes in orientation of the tub 12 may be monitored through known transducers 18, such as accelerometers, accelerometers combined with a gyroscope, load cells, distance gauges, and the like, at selected locations.

The tub 12 and the drum 14 may be mounted in the cabinet 20 such that the drum 14 may rotate about a rotational axis relative to the tub 12. The wash chamber 26 may be accessible from outside the cabinet 20 and closeable by the access door 28. The laundry treating appliance 10 may be configured to automatically treat laundry according to at least one cycle of operation.

The laundry treating appliance 10 may also include a wash aid dispensing system 30, a liquid distribution system 40, a liquid recycling/disposal system 50, and a drum drive system 60 including an axle 62 rotationally supporting the drum 14 about an axis of rotation, none of which will be described further except as necessary for a complete understanding of the invention.

The laundry treating appliance 10 may include a sump assembly 70 having a sump 72 defining a sump chamber 74 with a sump outlet 76, which may be fluidly coupled with the liquid recycling/disposal system 50, and a liquid pressure outlet 78. A sump head monitor 80 may include a pressure tube 82 closed at a first end 81, and fluidly coupled with the liquid pressure outlet 78 at a second end. The first end 81 may be provided with a pressure transducer 84 for sensing an air pressure within the pressure tube 82, which may be electrically coupled with the controller 22 through signal leads 86.

Figure 3:
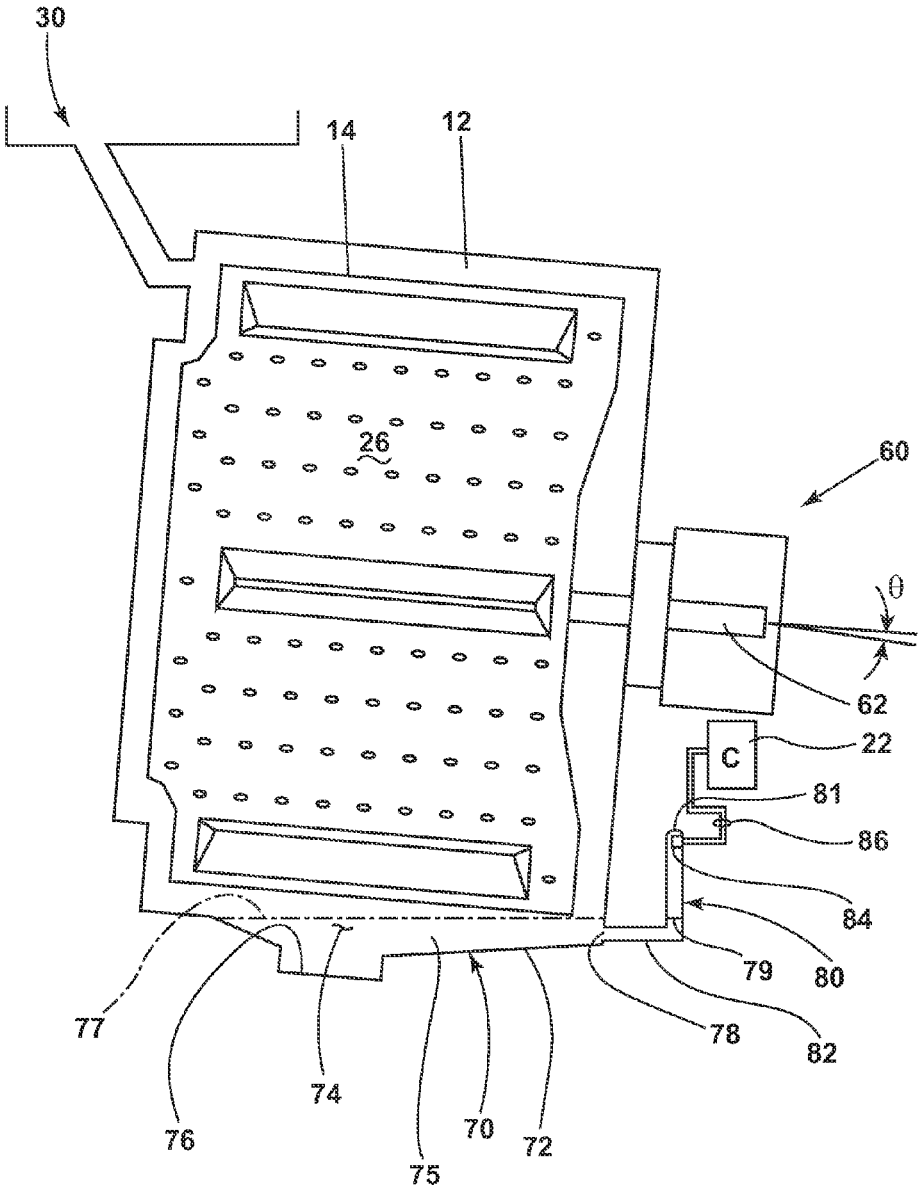
FIG. 3 is a sectional view taken longitudinally of the tub, sump, and drum of FIG. 2 positioned at a first attitude.
Figure 4:
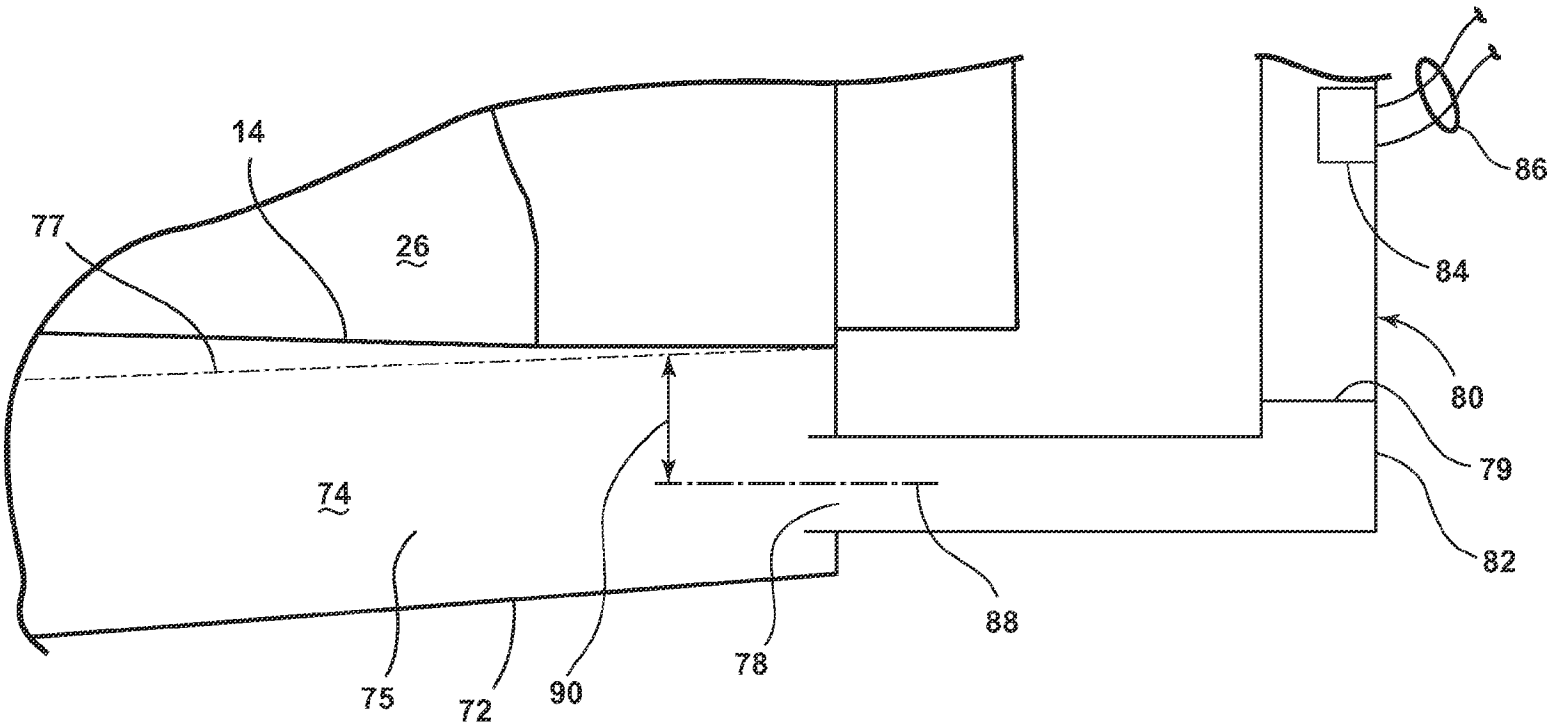
FIG. 4 is an enlarged portion of the sump and drum of FIG. 3.

FIGS. 3 and 4 illustrate a free liquid surface 77 in the sump 72 associated with a volume of liquid 75, As liquid 75 is delivered to the sump chamber 74, the free liquid surface 77 will rise to a level above the liquid pressure outlet 78. Initially, the liquid 75 will enter the pressure tube 82, and will continue to rise as the sump 72 is filled. When the free liquid surface 77 reaches a level in the liquid pressure outlet 78 at which the pressure transducer 84 is no longer open to the atmosphere, air will be trapped between a free liquid surface 79 in the pressure tube 82 and the closed end 81. The free liquid surfaces 77, 79 will continue to rise until filling of the sump 72 is terminated 79, and the air in the pressure tube 82 will be compressed, to be sensed by the transducer 84.

FIG. 4 illustrates the free liquid surface 77 in the sump 72 associated with a volume of liquid 75 shown in FIG. 3, corresponding to a tub pitch attitude at a first angle . The difference between the elevation of the liquid pressure outlet centerline 88 and the elevation of the free liquid surface 77 represents a pressure head 90. The pressure head 90 may correlate to a pressure, which may be expressed, for example, in terms of millimeters of head, grams per square centimeter, and the like, that may be sensed by the pressure transducer 84. The pressure head 90 value may be stored in the controller 22 in algorithmic or tabular form, and may represent a reference head.

Figure 5:
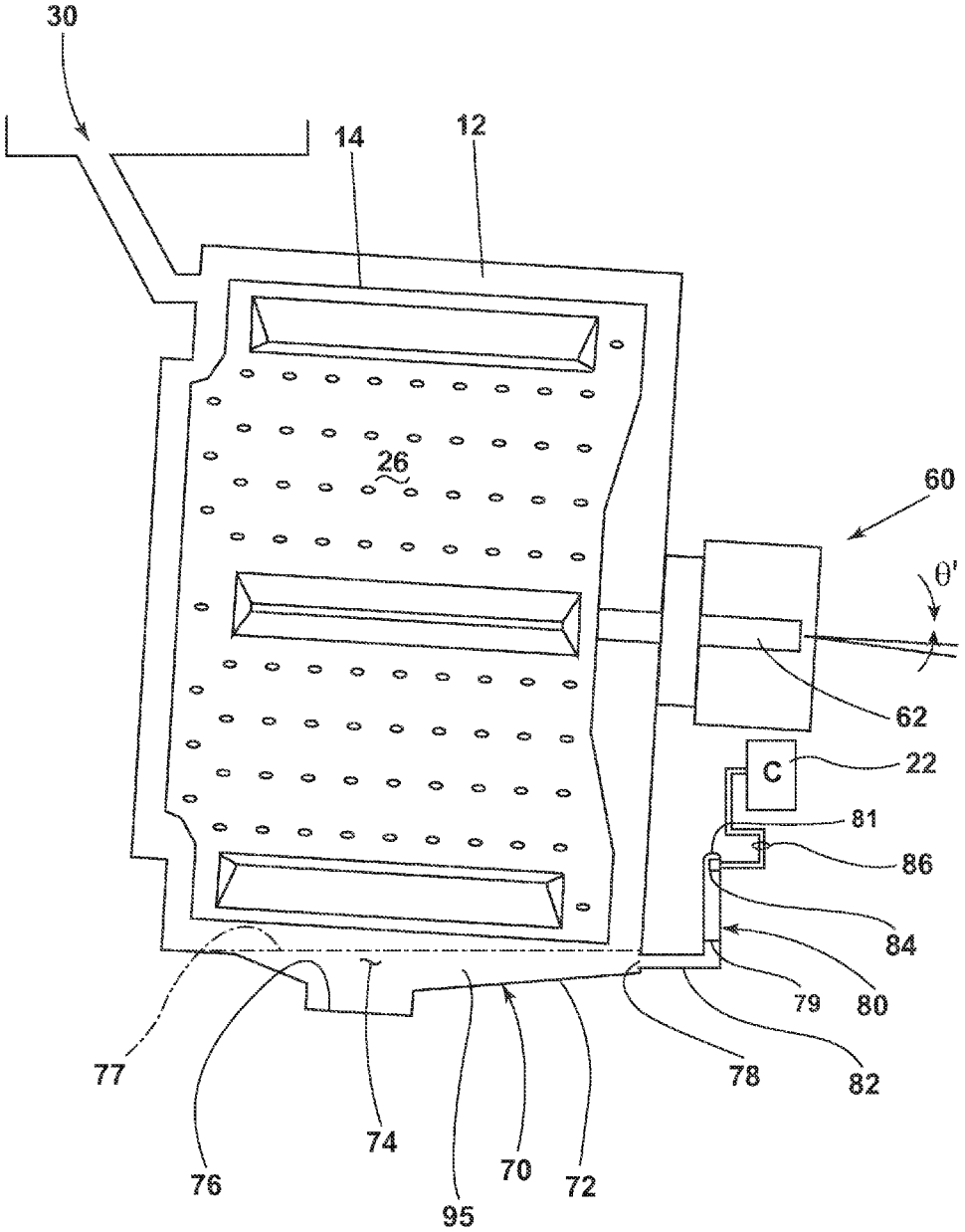
FIG. 5 is a sectional view taken longitudinally of the tub, sump, and drum of FIG. 2 positioned at a second attitude.

FIG. 5 illustrates an orientation of the tub 12 and sump 72 reflective of a downward tilt of the forward portion of the tub 12 due to an increase in load at the forward portion of the drum 14. The downward tilt of the front portion of the drum changes the pitch attitude angle, ', which results in the sump liquid 95 moving toward the front of the tub as shown in FIG. 5.

Figure 6:
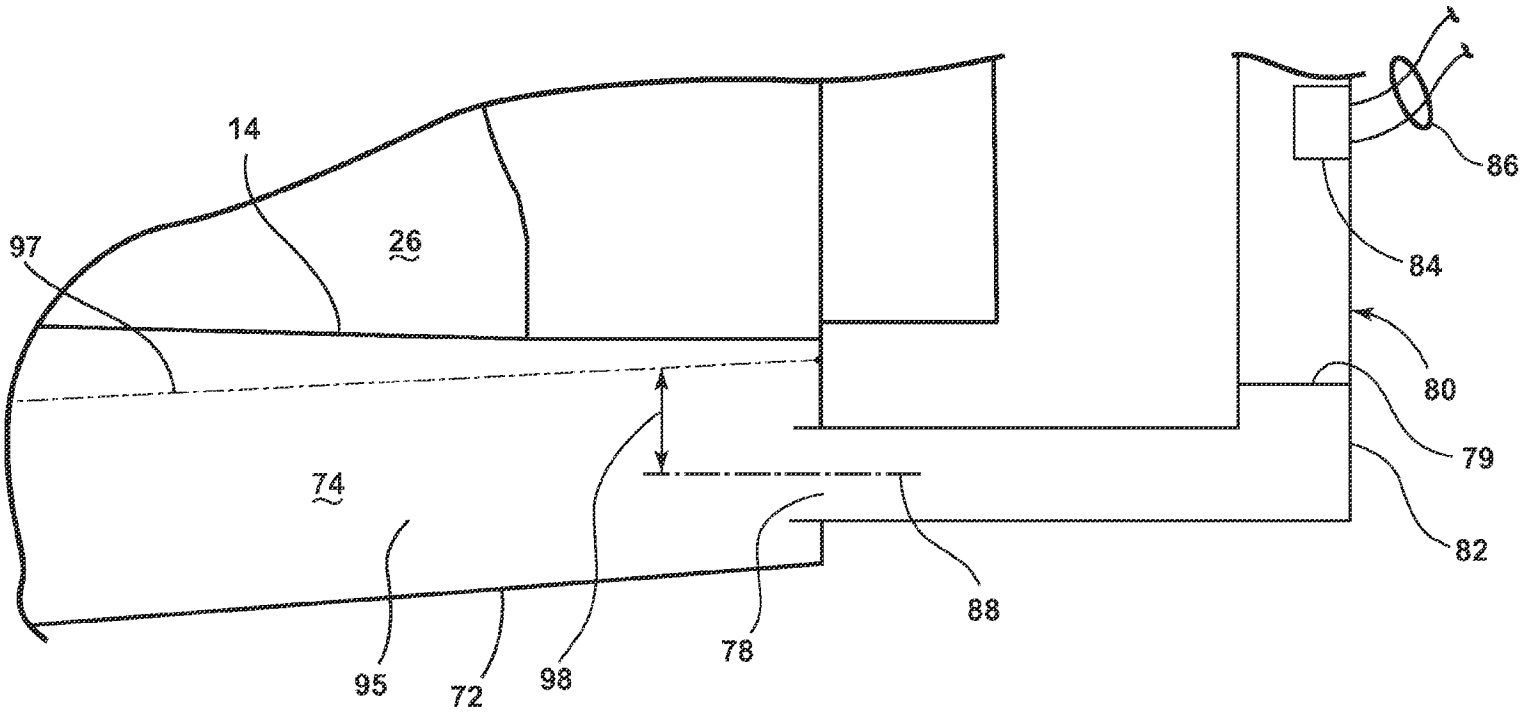
FIG. 6 is an enlarged portion of the sump and drum of FIG. 5.

Referring to FIG. 6, the forward movement of the sump liquid 95 reduces the liquid level as seen by the pressure sensor. The difference between the level of the liquid pressure outlet centerline 88 and the elevation of the free liquid surface 97 represents a pressure head 98 that is less than the pressure head 90 and may be sensed by the pressure transducer 84. This pressure head 98, or the reduction in pressure head relative to a reference head, may be stored in the controller 22 in algorithmic or tabular form.

It should be understood that a change in the pressure head as sensed by the pressure transducer 84 may result from a change in pitch of the tub 12 and sump 72 (i.e. about an axis perpendicular to the rotational axis), roll of the tub 12 and sump 72 (i.e. about the rotational axis), or a combination of pitch and roll.

The laundry treating appliance 10 may be operated so that selecting a cycle of operation through the user interface 24 may determine a volume of liquid to be delivered to either or both of the tub interior and the treating chamber 26. A correlation between a cycle of operation and a volume of liquid may be established theoretically and/or empirically, and stored in the controller 22. Alternate cycles of operation selectable on the user interface 24, e.g. normal, delicate, heavy duty, woolens, and the like, may be correlated in the controller 22 with alternate volumes of liquid. Selection of a cycle may determine a volume of liquid to be delivered.

After selection of a volume of liquid, the selected volume may be delivered to either or both the tub interior and/or the treating chamber 26. During delivery, the volume of liquid may be determined by a sensor operably coupled with the tub 12, such as the pressure monitor described previously herein. The volume of liquid may be correlated to a level of liquid in either the tub interior or the sump 72. The level of liquid may be determined by sensing the pressure head of the liquid relative to a selected datum associated with the tub 12.

The volume of liquid delivered may be correlated to the level of liquid in the tub interior or the sump 72 as determined by the pressure monitor. A change in attitude of the tub 12 may also be determined during delivery of the volume of liquid. The volume of delivered liquid may be corrected for an error caused by the determined change in the attitude of the tub 12. In effect, the greater the change in attitude, the lower the pressure head sensed by the pressure sensor, and, in the example described herein, the greater the correction in a volume of liquid.

Thus, a change in attitude may include determining a change in the attitude that alters the pressure head, a change in the attitude that changes the pitch of the rotational axis, or a change in roll of the tub about the rotational axis. Correcting for an error in sensing the volume of liquid may include adjusting the level of the liquid. This adjustment in sensed level may include establishing a new liquid level that equates with a determined liquid amount for the change in attitude. It may also include establishing a correction factor for the sensed level of liquid, or establishing a change in attitude that alters the pressure head of the liquid with respect to a datum. A change in attitude may also include determining a change in either or both pitch of the rotational axis and roll about the rotational axis.

A fill operation may be performed for selected laundry load types. The attitude of the tub 12 and/or sump may be monitored by suitably placed accelerometers, distance gages, and the like, and correlated to a volume of liquid in the sump 72 and a change in pressure sensed by the pressure transducer 84 for each laundry load type. This empirical data may be utilized to develop algorithms or families of curves relating a change in sensed pressure from the transducer 84 and a change in attitude to a volume of liquid in the sump 72. The filling operation may then be controlled to optimize the volume of liquid to be utilized in a selected operation cycle.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a tub defining an interior, a drum defining a treating chamber receiving laundry for treatment, with the drum located within the interior and rotatable about a rotational axis, and configured to automatically treat laundry according to a cycle of operation, the method comprising:

determining an amount of liquid to be supplied to at least one of the interior and the treating chamber for the cycle of operation;

supplying liquid to at least one of the interior and the treating chamber;

sensing the amount of supplied liquid using a sensor operably coupled to the tub;

determining a change in the attitude of the tub for the cycle of operation during the supplying of the liquid; and correcting for an error in sensing the amount of supplied liquid caused by the determined change in the attitude of the tub for the cycle of operation;

wherein the change in the attitude of the tub is based on the laundry loaded into the treating chamber for the cycle of operation.

2. The method of claim 1 wherein determining the amount of liquid comprises receiving a user input representing a liquid amount for the cycle of operation.

3. The method of claim 1 wherein determining the amount of liquid comprises the laundry treating appliance automatically determining the amount of liquid.

4. The method of claim 1 wherein supplying liquid comprises supplying liquid directly to the treating chamber.

5. The method of claim 1 wherein supplying liquid comprises supplying liquid directly to the interior.

6. The method of claim 1 wherein sensing the amount of supplied liquid comprises sensing the level of liquid in the interior.

7. The method of claim 6 wherein sensing the level of liquid comprises sensing the level of liquid within a sump of the tub.

8. The method of claim 6 wherein sensing the level of liquid comprises sensing the pressure head of the liquid relative to a location in the tub.

9. The method of claim 8 wherein determining a change in the attitude comprises determining a change in the attitude that alters the pressure head of the liquid.

10. The method of claim 9 wherein determining a change in the attitude comprises determining a change in pitch of the rotational axis.

11. The method of claim 10 wherein determining a change in the attitude comprises determining a change in roll of the tub about the rotational axis.

12. The method of claim 10 wherein correcting for an error in sensing comprises adjusting the sensed level of the liquid.

13. The method of claim 12 wherein adjusting the sensed level of liquid comprises providing a new liquid level that equates with the determined liquid amount for the change in attitude.

14. The method of claim 13 wherein adjusting the sensed level of liquid comprises providing a correction factor for the sensed level of liquid.

15. The method of claim 1 wherein determining a change in the attitude comprises determining a change in the attitude that alters the pressure head of the liquid with respect to a reference point in the tub.

16. The method of claim 1 wherein determining a change in the attitude comprises determining a change in at least one of pitch of the rotational axis and roll about the rotational axis.

17. The method of claim 1 wherein determining a change in the attitude comprises determining a change in both pitch of the rotational axis and roll about the rotational axis.

18. The method of claim 1 wherein correcting for an error in the sensing comprises adjusting the sensed amount of the liquid.

19. The method of claim 18 wherein adjusting the sensed amount of liquid comprises providing a new liquid amount that equates with the determined liquid amount for the change in attitude.

20. The method of claim 18 wherein adjusting the sensed amount of liquid comprises providing a correction factor for the sensed amount of liquid.

21. A method of performing a fill operation of a cycle of operation in a laundry treating appliance having a tub defining an interior, a drum defining a treating chamber receiving laundry for treatment, with the drum located within the interior and rotatable about a rotational axis, and configured to automatically treat laundry according to the cycle of operation, the method comprising:

determining an amount of liquid to be supplied for the fill operation to at least one of the interior and the treating chamber;

supplying liquid to at least one of the interior and the treating chamber;

sensing the amount of supplied liquid using a sensor operably coupled to the tub;

during the supplying of the liquid, determining a change in the attitude of the tub based on the laundry loaded into the treating chamber; and correcting for an error in sensing the amount of supplied liquid caused by the determined change in the attitude of the tub.

22. The method of claim 21 wherein sensing the amount of supplied liquid comprises sensing the level of liquid in the interior.

23. The method of claim 21 wherein determining a change in the attitude comprises determining a change in the attitude that alters the pressure head of the liquid with respect to a reference point in the tub.

24. The method of claim 21 wherein correcting for an error in the sensing comprises adjusting the sensed amount of the liquid.

* * * * *